US008277030B2

(12) United States Patent
Nagate

(10) Patent No.: US 8,277,030 B2
(45) Date of Patent: Oct. 2, 2012

(54) LIQUID EJECTING APPARATUS

(75) Inventor: Toru Nagate, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 776 days.

(21) Appl. No.: 12/130,726

(22) Filed: May 30, 2008

(65) Prior Publication Data

US 2008/0297553 A1 Dec. 4, 2008

(30) Foreign Application Priority Data

Jun. 1, 2007 (JP) ..... 2007-146673

(51) Int. Cl.
*B41J 2/04* (2006.01)

(52) U.S. Cl. ..... 347/68

(58) Field of Classification Search ..... None
See application file for complete search history.

(56) References Cited

U.S. PATENT DOCUMENTS

| | | | | |
|---|---|---|---|---|
| 6,945,633 | B2 * | 9/2005 | Imanaka et al. | 347/58 |
| 2006/0066690 | A1 * | 3/2006 | Katayama | 347/71 |

FOREIGN PATENT DOCUMENTS

| | | |
|---|---|---|
| JP | 2001-162811 | 6/2001 |
| JP | 2002-052715 | 2/2002 |
| JP | 2003-011383 | 1/2003 |
| JP | 2005-053081 | 3/2005 |
| JP | 2005-096150 | 4/2005 |
| JP | 2005-254666 | 9/2005 |
| JP | 2006-334967 | 12/2006 |

* cited by examiner

*Primary Examiner* — Matthew Luu
*Assistant Examiner* — Alejandro Valencia
(74) *Attorney, Agent, or Firm* — Workman Nydegger

(57) ABSTRACT

A liquid ejecting head unit includes head main bodies capable of ejecting liquid droplets from nozzle openings by applying pressure to liquid inside pressure generating chambers communicated with the nozzle openings. Liquid flow paths that are formed for the head main bodies connect the nozzle openings including the pressure generating chambers and storage members that store liquid to be supplied to the pressure generating chambers. Heating members are disposed in the vicinity of the liquid flow paths and heat the liquid flowing through the liquid flow paths. A control unit controls the heating members. Temperature detecting units detect temperatures of the liquid flowing through the liquid flow paths. The control unit controls the heating members based on the temperatures of the liquid, which are detected by the temperature detecting units and lengths of the liquid flow paths extending from the storage members to the head main bodies.

4 Claims, 5 Drawing Sheets

LIQUID EJECTING APPARATUS

CROSS-REFERENCE TO RELATED APPLICATIONS

This application claims the benefit of priority to Japanese Patent Application No. 2007-146673 filed Jun. 1, 2007, the contents of which are hereby incorporated by reference in their entirety.

BACKGROUND

1. Technical Field

The present invention relates to a liquid ejecting head capable of ejecting liquid droplets from a plurality of nozzles and a liquid ejecting apparatus.

2. Related Art

As an ink jet recording head unit having an ink jet recording head, an ink jet recording head unit having a plurality of ink jet recording heads capable of ejecting ink droplets, which is supplied from an ink cartridge filled with ink or the like, from an nozzle opening, a head case that is bonded to a side opposite to an ink ejecting face of the ink jet recording head, and a cartridge case that holds a plurality of recording head main bodies and head cases is, for example, disclosed in Japanese Patent Application No.JP-A-2001-162811.

In addition, recently, in order to miniaturize the ink jet recording head unit, ink jet recording head units having different lengths of converging flow path sections that connect ink supply needles inserted into ink supplying means and ink introduction openings disposed on a bonding member of a head main body, for example, have been proposed in Japanese Patent Application Nos.JP-A-2002-52715 and JP-A-2003-11383.

However, in the above-described ink jet recording head unit, since the lengths of the converging flow paths are different from one another, heat is exchanged between ink and a converging flow path when the ink flows through the converging flow path. Accordingly, the temperature of the ink changes depending on the length of the converging flow path. As a result, non-uniformity of viscosities of ink ejected from the nozzle openings occurs, and thereby there is a problem that ejection characteristics of the ink ejected from the nozzle openings become different from one another.

SUMMARY

An advantage of some aspects of the invention is that it provides a liquid ejecting head unit capable of substantially uniformizing ejection characteristics of liquid droplets ejected from nozzle openings by substantially uniformizing temperatures of liquid droplets ejected from the nozzle openings even in a case where the lengths of liquid flow paths that connect storage members in which liquid is stored and the nozzle openings from which the liquid is ejected are different from one another.

One aspect of the invention is a liquid head comprising a plurality of head main bodies capable of ejecting liquid droplets from a plurality of nozzle openings by applying pressure to liquid inside pressure generating chambers communicated with the plurality of nozzle openings using pressure generating elements; a plurality of liquid flow paths that are formed for the plurality of head main bodies and connect the plurality of nozzle openings including the pressure generating chambers and storage members that store liquid to be supplied to the pressure generating chambers; a plurality of heating members that are disposed in the vicinity of the liquid flow paths and heat the liquid flowing through the liquid flow paths; a control unit that controls the plurality of heating members; and temperature detecting units that detect temperatures of the liquid flowing through the liquid flow paths. The control unit controls the plurality of heating members based on the temperatures of the liquid which are detected by the temperature detecting units and lengths of the liquid flow paths extending from the storage members to the head main bodies.

The aspects of the invention other than that described above and objects thereof will become apparent by reading descriptions of this specification with reference to the accompanying drawings.

BRIEF DESCRIPTION OF THE DRAWINGS

The invention will be described with reference to the accompanying drawings, wherein like numbers reference like elements.

For complete understanding of the present invention and advantages thereof, descriptions below and the accompanying drawings may be referred.

DESCRIPTION OF EXEMPLARY EMBODIMENTS

Figure 1:
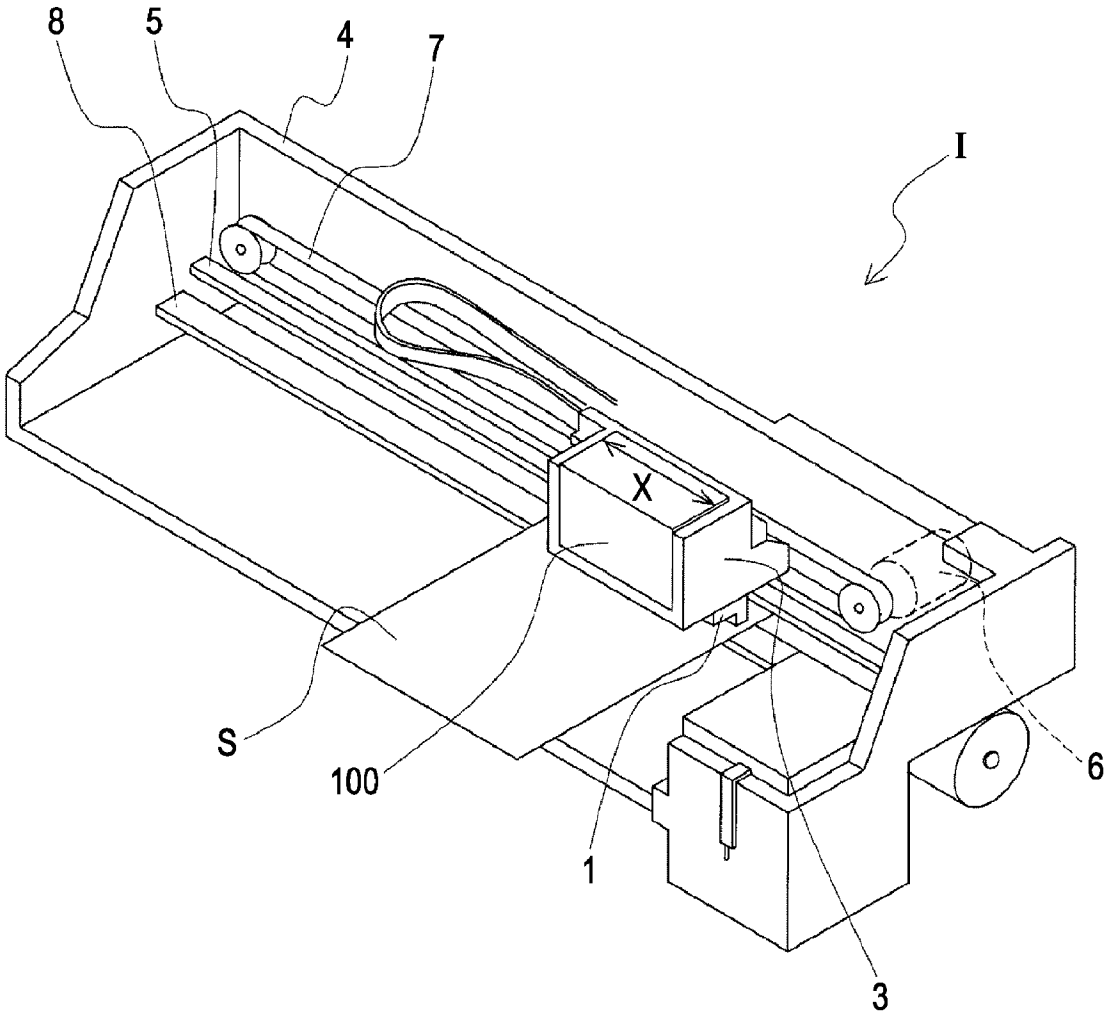
FIG. 1 is a schematic perspective view of an ink jet recording apparatus according to Embodiment 1 of the invention.

By descriptions in this specification and the accompanying drawings, at least the followings become apparent.

A liquid ejecting head unit according to an aspect of the present invention includes: a plurality of head main bodies that eject liquid droplets from a plurality of nozzle openings by applying pressure to liquid inside pressure generating chambers communicated with the plurality of nozzle openings using pressure generating means; a plurality of liquid flow paths that are formed for the plurality of head main bodies and connect the plurality of nozzle openings including the pressure generating chambers and storage members that store liquid to be supplied to the pressure generating chambers; a plurality of heating members that are disposed in the vicinity of the liquid flow paths and heat the liquid flowing through the liquid flow paths; a control unit that controls the plurality of heating members; and temperature detecting units that detect temperatures of the liquid flowing through the liquid flow paths. The control unit controls the plurality of heating members based on the temperatures of the liquid which are detected by the temperature detecting units and lengths of the liquid flow paths extending from the storage members to the head main bodies.

The liquid ejecting head unit configured as described above can maintain the temperatures of droplets ejected from the nozzle openings to be uniform by controlling the temperatures of liquid flowing through the flow paths based on the lengths of flow paths.

In addition, in the liquid ejecting head unit, it is preferable that the heating members are disposed in the head main bodies.

In such a case, since the liquid flowing through the liquid flow paths can be heated in an area close to the nozzle openings, the temperatures of the liquid droplets ejected from the nozzle openings can be precisely uniformized in an easy manner.

In addition, in the liquid ejecting head unit, it is preferable that the head main bodies have a plurality of laminated metal layers and the heating members are disposed to be brought into contact with any one of the plurality of metal layers.

In such a case, since the heating member can be disposed between any metal plates, it is possible to manufacture a head main body having a heating member in an easy manner. In addition, since the part of the head main body which is configured by the metal layers has high conductivity, the liquid flowing through the part of the liquid flow path which is formed by the metal layers can be immediately heated by the heating member.

In addition, in the liquid ejecting head unit, it is preferable that the head main body has a nozzle forming member in which the nozzle opening is formed and an insulation layer is disposed between the heating member and the nozzle forming member.

In such a case, the liquid flowing through the liquid flow path can be heated while heating of the nozzle forming member is prevented. As a result, it is possible to suppress solidification of the liquid in the vicinity of the nozzle opening of the nozzle forming member.

In addition, in the liquid ejecting head unit, it is preferable that the head main body includes a reservoir substrate that has a reservoir for receiving supply of liquid from the storage member and supplying the liquid to the plurality of pressure generating chambers and a compliance substrate that has a space in an area facing the reservoir of the reservoir substrate. The heating members are disposed in the space.

In such as case, the liquid to be supplied to the pressure generating chambers can be heated at once, and the size in the head is not increased by effectively using the space.

Hereinafter, appropriate embodiments of the invention will be described with reference to the accompanying drawings. The embodiment described below is described as an example of the invention, and it cannot be considered that all the described configurations are essential constituent elements of the invention.

FIG. 1 is a schematic perspective view of an ink jet recording apparatus as an example of a liquid ejecting apparatus according to Embodiment 1 of the invention. As shown in FIG. 1, the ink jet recording apparatus I as an example of the liquid ejecting apparatus includes an ink jet recording head unit 1 as an example of a liquid ejecting head unit. The ink jet recording head unit 1 is disposed such that an ink cartridge 100, which is a storage member, can be detachably attached thereto. The ink jet recording head unit 1 in which the ink cartridge 100 is loaded is installed to a carriage 3 that is a holding member.

The carriage 3 to which the ink jet recording head unit 1 is installed is disposed in a carriage shaft 5 attached to an apparatus main body 4 to be movable in the shaft direction. The ink jet recording head unit 1, for example, is configured to eject a black ink composition and color ink compositions.

The carriage 3 to which the ink jet recording head unit 1 is installed moves along the carriage shaft 5 as a driving force of a driving motor 6 is transferred to the carriage 3 through a plurality of gears that are not shown in the figure and a timing belt 7. In the apparatus main body 4, a platen 8 is disposed along the carriage shaft 5. A recording sheet S that is a recording medium such as a paper sheet fed by a paper feed roller, not shown in the figure, or the like is configured to be transported on the platen 8.

Figure 2:
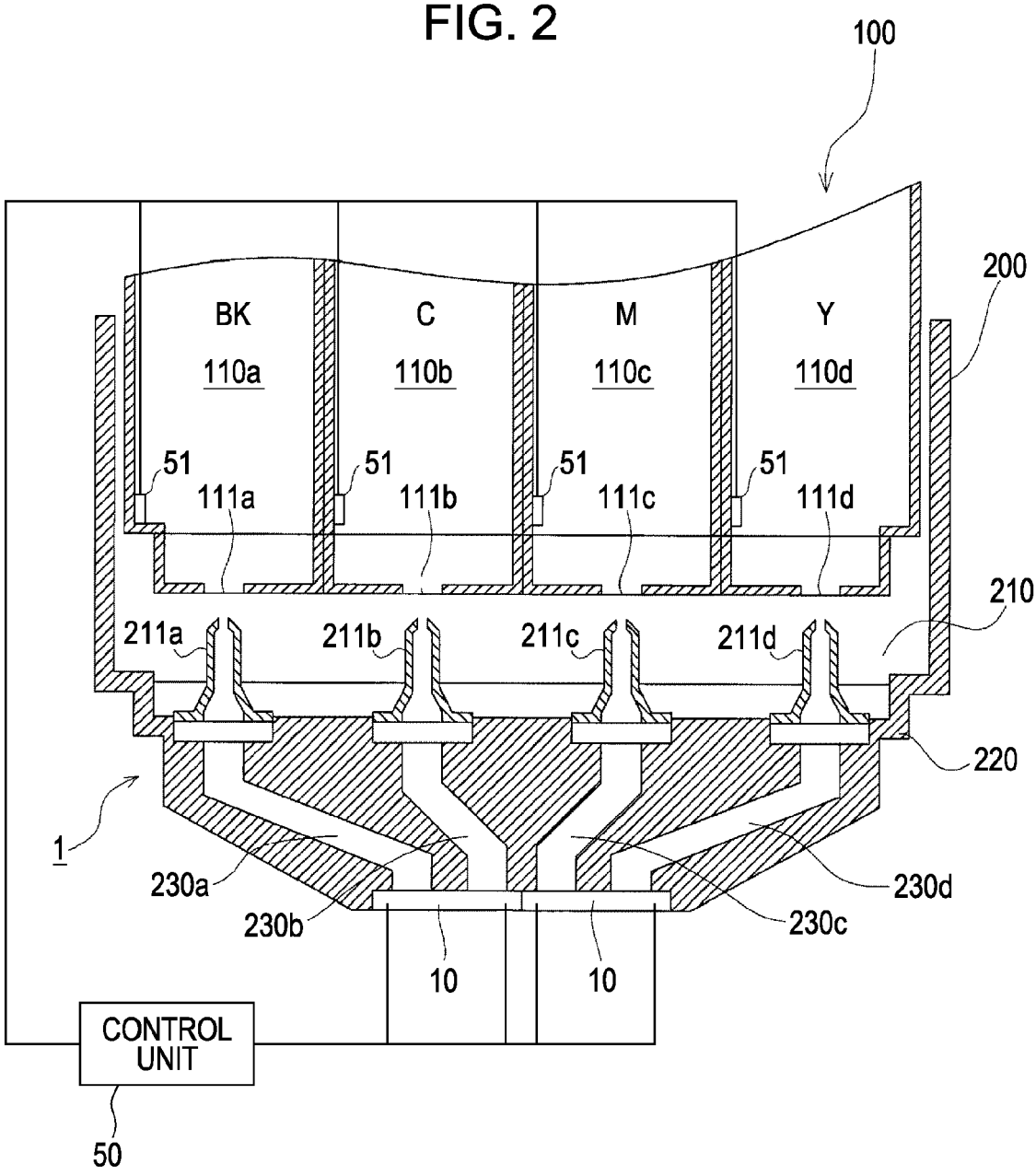
FIG. 2 is a schematic cross-sectional view of a head unit and an ink cartridge according to Embodiment 1.

Here, the ink jet recording head unit 1 that is an example of the liquid ejecting head unit according to this embodiment will be described in detail. FIG. 2 is a schematic cross-sectional view of the ink jet recording head unit and the ink cartridge taken along direction X shown in FIG. 1.

As shown in the figure, the ink jet recording head unit 1 has a frame 200 made of metal. In addition, on the upper surface of the frame 200, a cartridge holder part 210 to which the ink cartridge 100 can be attached is formed.

The ink cartridge 100 is formed of a hollow box shaped member having its inside partitioned and configured by a plurality of ink chambers, and one type of ink is stored in each ink chamber. In this embodiment, the ink cartridge 100 has four ink chambers 110*a* to 110*d* that store black ink BK, cyan ink C, magenta ink M, and yellow ink Y. In bottom portions of the ink chambers 110*a* to 110*d*, needle connecting portions 111*a* to 111*d* into which ink supply needles 211*a* to 211*d* are inserted are disposed. The needle connection portions 111*a* to 111*d* serve as ink outlets of the ink chambers 110*a* to 110*d*.

In the lower part of the frame 200, a base plate part 220 is formed. In the base plate part 220, converging flow paths 230*a* to 230*d* that are communicated with the ink supply needles 211*a* to 211*d* are formed. To the lower side of the base plate part 220, a plurality of the head main bodies 10 connected to the converging flow paths 230*a* to 230*d* are attached from the lower side, and ink stored in the ink cartridge 100 is configured to be supplied to the head main bodies 10. In other words, the head main bodies 10 are communicated with the ink chambers 110*a* to 110*d* through ink supply paths formed by ink supply needles 211*a* to 211*d* and the converging flow paths 230*a* to 230*d*, and the ink stored in the ink cartridge 100 can be supplied to the head main bodies 10.

Although described later in detail, a control unit 50 connected to a heating layer that configures each head main body 10 is disposed. The control unit 50 is connected to a temperature sensor 51 that is temperature detecting means disposed inside the ink chambers 110*a* to 110*d*.

Figure 3:
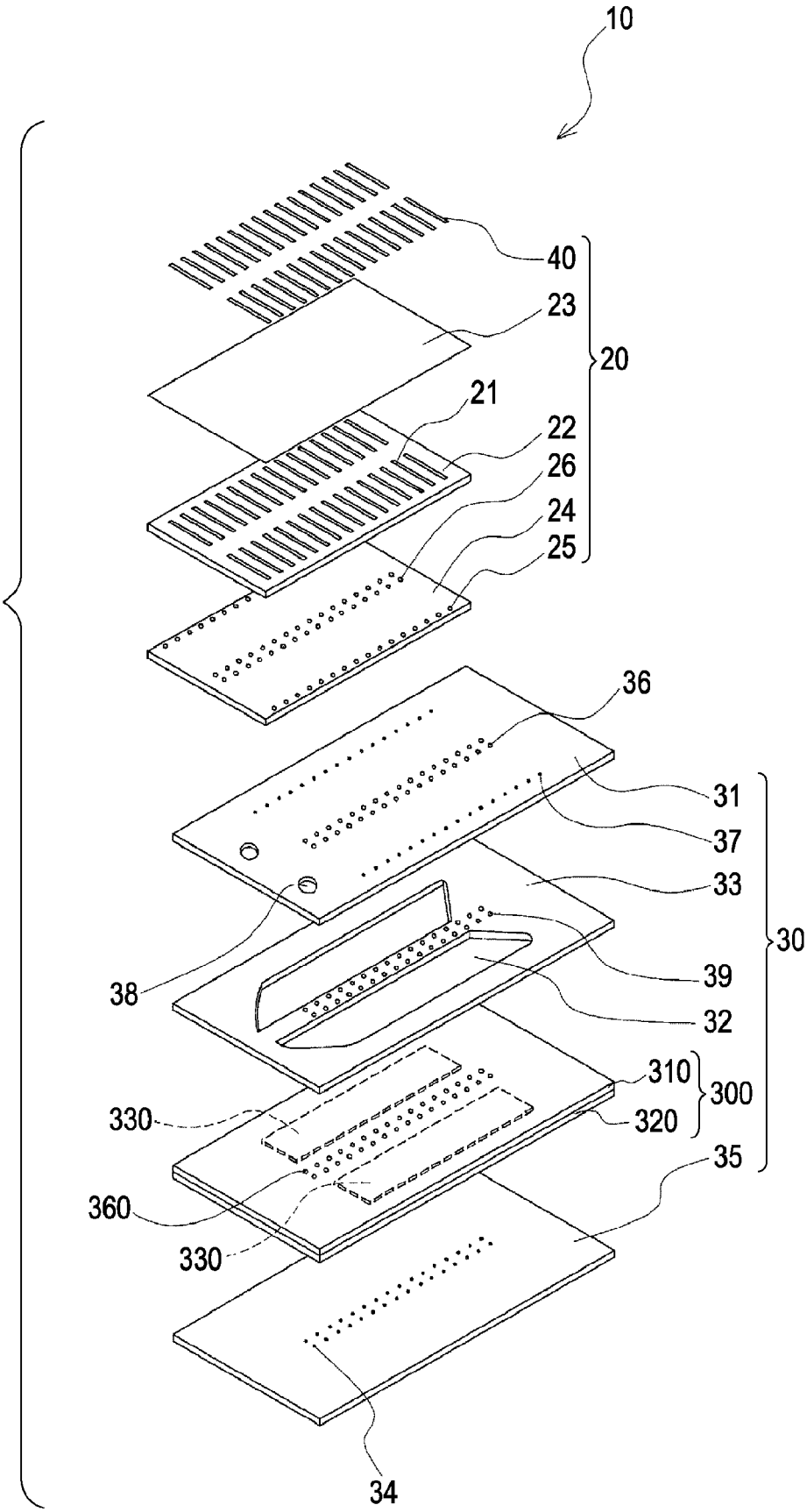
FIG. 3 is an exploded perspective view of a head main body according to Embodiment 1.
Figure 4:
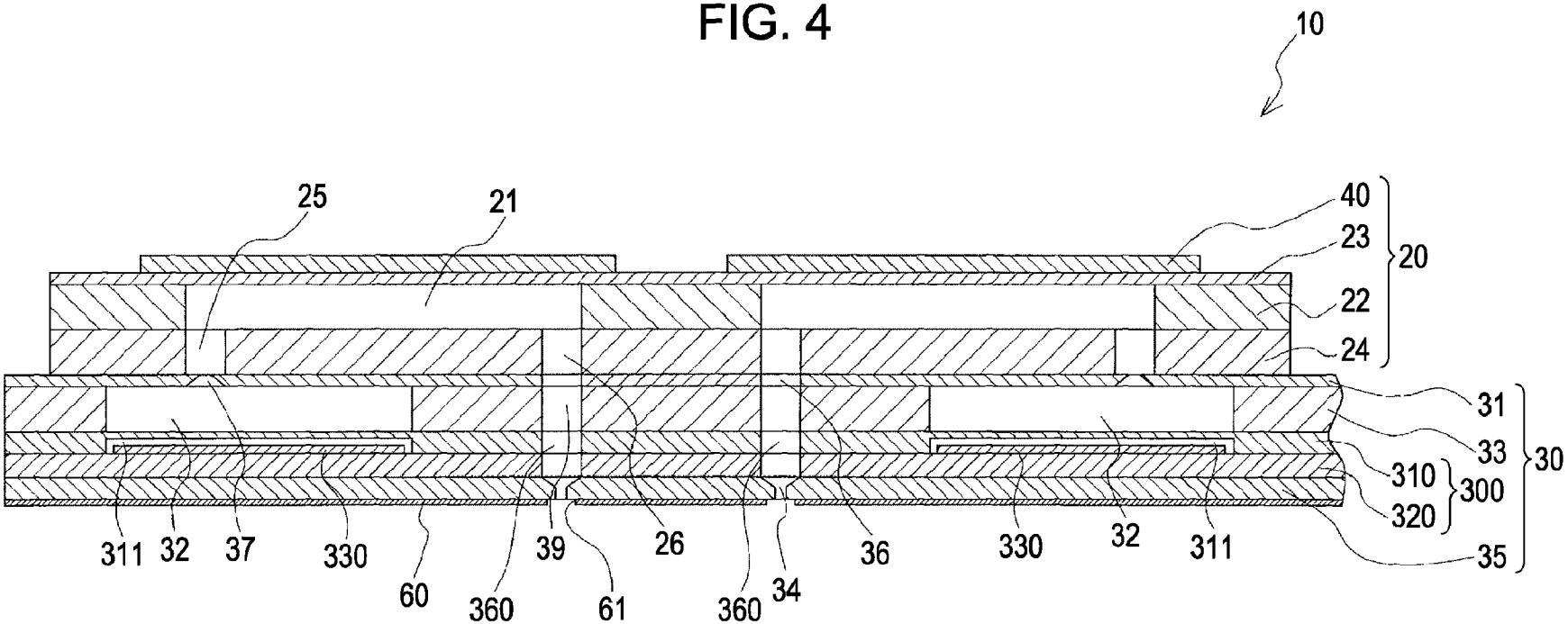
FIG. 4 is a schematic cross-sectional view of a head main body according to Embodiment 1.

Next, the head main body 10 will be described. FIG. 3 is an exploded perspective view of the head main body, and FIG. 4 is a cross-sectional view of the head main body. As shown in the figures, the head main body 10 according to this embodiment is configured by an actuator unit 20 and a flow path unit 30 to which the actuator unit 20 is fixed.

The actuator unit 20 is an actuator device having a piezoelectric element 40. The actuator unit 20 has a flow path forming substrate 22 in which a pressure generating chamber 21 is formed, a diaphragm 23 disposed on one side of the flow path forming substrate 22, and a pressure generating chamber base plate 24 disposed on the other side of the flow path forming substrate 22.

The flow path forming substrate 22 includes spots in which plates, for example, formed of stainless steel are laminated. In this embodiment, in the flow path forming substrate 22, two rows are formed by a plurality of the pressure generating chambers 21 aligned along its width direction. To one side of the flow path forming substrate 22, a diaphragm 23, for example, formed of a zirconia thin film is fixed. In addition, one side of the pressure generating chamber 21 is sealed by the diaphragm 23.

The pressure generating chamber base plate 24 is fixed to the other side of the flow path forming substrate 22 so as to seal the other side of the pressure generating chamber 21. In addition, the pressure generating chamber base plate 24 has a supply communication hole 25 that is disposed in the vicinity of one end portion of the pressure generating chamber 21 in the longitudinal direction and enables the pressure generating chamber 21 and a reservoir described later to be communicated with each other and a nozzle communication hole 26 that is disposed in the vicinity of the other end portion of the pressure generating chamber 21 in the longitudinal direction and is communicated with a nozzle opening 34 to be described later.

The piezoelectric elements 40 are disposed in areas of the diaphragm 23 which face the pressure generating chambers 21. For example, since two rows of the pressure generating chambers 21 are disposed in this embodiment, two rows of the piezoelectric elements 40 are disposed.

Here, each piezoelectric element 40 is configured by a lower electrode film disposed on the diaphragm 23, a piezoelectric body layer disposed independently for each pressure generating chamber 21, and an upper electrode film disposed on the piezoelectric body layer. The piezoelectric body layer is formed by attaching or printing a green sheet formed of a piezoelectric material. In addition, the lower electrode film is disposed over the piezoelectric body layer disposed to be aligned, becomes a common electrode of the piezoelectric elements 40, and serves as a part of the diaphragm.

In addition, among the flow path forming substrate 22, the diaphragm 23, and the pressure generating chamber base plate 24 that are layers of the actuator unit 20, at least the flow path forming substrate 22 and the pressure generating chamber base plate 24 are integrally formed by molding stainless steel to have a predetermined thickness, for example, punching the pressure generating chambers 21 and the like in the base plate 24, and then laminating and bonding the flow path forming substrate 22. Thereafter, the piezoelectric elements 40 are formed on the diaphragm 23.

The flow path unit 30 is configured by an ink supply opening forming substrate 31 that is bonded to the pressure generating chamber base plate 24 of the actuator unit 20 using an adhesive agent, a reservoir forming substrate 33 in which a reservoir 32 that becomes a common ink chamber of the plurality of the pressure generating chambers 21 is formed, a compliance substrate 300 that is bonded to the reservoir forming substrate 33, and a nozzle plate 35 in which the nozzle openings 34 are formed.

The ink supply opening forming substrate 31 is formed of a thin film of stainless steel. The ink supply opening forming substrate 31 is configured by punching ink supply openings 36 that connect the nozzle openings 34 and the pressure generating chambers 21 and ink supply openings 37 that connects the reservoir 32 and the pressure generating chambers 21 together with the above-described supply communication holes 25. In addition, in the ink supply opening forming substrate 31, an ink introduction opening 38 that is communicated with the reservoirs 32 and is connected to the above-described ink supply path is disposed.

The reservoir forming substrate 33 has a reservoir 32 that receives supply of ink from the ink cartridge 100 and supplies the ink to the pressure generating chambers 21 and nozzle communication holes 39 that communicates the pressure generating chambers 21 and the nozzle openings 34 with each other which are disposed, for example, in a plate member having corrosion resistance such as stainless steel which is appropriate for forming the ink flow path.

The compliance substrate 300 is configured by an upper compliance substrate 310 and a lower compliance substrate 320 which are formed of metal such as stainless steel. In addition, the compliance substrate 300 has nozzle communication holes 360 in the center portion in the width direction for communicating the pressure generating chambers 21 and the nozzle openings 34. The compliance substrate 300 is bonded to a side of the reservoir forming substrate 33 which is opposite to the flow path forming substrate 22 and seals the other side of the reservoir 32.

In an area between the upper compliance substrate 310 and the lower compliance substrate 320 which faces the reservoir 32, spaces 311 are formed. In each space 311, a heating layer 330 formed of Nichrome, copper, or the like is disposed. In addition, to an end portion of the heating layer 330 in the longitudinal direction, a lead-out wire (not shown) that is electrically connected to the control unit 50 is connected, and accordingly, the calorific value of the heating layer 330 can be controlled by the control unit 50. In particular, the heating layers 330 are controlled based on temperatures of ink inside the ink cambers 110*a* to 110*d* which are detected by the above-described temperature sensors 51 such that the temperatures of ink ejected from the nozzle openings 34 are uniform. In other words, the heating layers 330 are individually controlled based on the temperatures of the ink. In this embodiment, for example, relationship among the temperatures inside the ink chambers, the lengths of the flow paths from the ink chambers 110*a* to 110*d* to the head main bodies 10, and more particularly, to the nozzle arrays constituting the head main bodies 10, and calorific values of the heating layers 330 which are required to uniformize the temperatures of the ink ejected from the nozzle openings 34 at the temperature and the length is acquired for each ink in advance. Then, by controlling the calorific values of the heating layers 330 based on the relationship, the temperatures of the ink ejected from the nozzle openings 34 can be uniformized. Here, the reason why the lengths of the flow paths extending from the ink chambers 110*a* to 110*d* to the head main bodies 10, and more particularly, to the nozzle arrays constituting the head main bodies 10 are considered as one factor for controlling the calorific values is that the lengths of the flow paths extending from the ink chambers 110*a* to 110*d* to the head main bodies 10 are different for each ink flow path and the degrees of hardening of the viscosity are different depending on the differences.

Here, in this embodiment, since the compliance substrate 300 is configured by a plurality of laminated metal plates and the heating layers 330 can be formed between the metal plates, the head main body 10 having the heating layers 330 can be easily manufactured. In addition, since the compliance substrate 300 is configured by metal plates and has high thermal conductivity, the ink inside the reservoir 32 can be immediately heated.

The nozzle plate 35 is formed by punching nozzle openings 34 in a thin film, for example, formed of stainless steel with a same aligning pitch as that of the pressure generating chambers 21. For example, in this embodiment, since two rows of the pressure generating chambers 21 are disposed in the flow path unit 30, two rows of the nozzle openings 34 are formed in the nozzle plate 35. In addition, in an ink ejecting surface side that is a side of the nozzle plate 35 opposite to the reservoir forming substrate 33, a liquid repellent film 60 is disposed.

The flow path unit 30 is formed by fixing the ink supply opening forming substrate 31, the reservoir forming substrate 33, the compliance substrate 300, and the nozzle plate 35 by using an adhesive agent, a thermal welding film, or the like. The flow path unit 30 and the actuator unit 20 are bonded through an adhesive agent or a thermal welding film to be fixed.

In the head main body 10 formed by the actuator unit 20 and the flow path unit 30, an ink introduction opening 38, a reservoir 32, an ink supply opening 37, a supply communication hole 25, a pressure generating chamber 21, nozzle communication holes 26, 36, and 39, and a nozzle opening 34 are disposed as an ink flow path. Accordingly, in this embodiment, a liquid flow path that connects the nozzle opening 34 and the ink cartridge 100 is formed by the ink flow path and the above-described ink supply path.

As described above, by configuring the ink jet recording head unit 1, the temperature of ink inside each reservoir 32 is controlled, and thereby the temperatures of ink ejected from the nozzle openings 34 can be uniformized. As a result, ejection characteristics of the ink ejected from the nozzle openings 34 can be uniformized.

In the ink jet recording head unit according to this embodiment, after the inside from the reservoir 32 up to the nozzle opening 34 is filled with ink by receiving the ink from the ink cartridge 100, a voltage is applied between the lower electrode film and the upper electrode film that correspond to each pressure generating chamber 21 in accordance with a record signal from a driving circuit not shown in the figure, and the flexural deformation of the piezoelectric body layer and the diaphragm 23 are formed. Accordingly, the pressure inside each pressure generating chamber 21 increases, and thereby ink droplets are ejected from each nozzle opening 34.

In addition, in the above-described embodiments, the heating layer 330 serving as a heating member is disposed in the vicinity of the reservoir 32 inside each head main body 10. However, the heating member is not particularly limited as long as it can heat the ink flowing through the liquid flow path, and the position of the heating member is not particularly limited. For example, a heating layer is disposed in the vicinity of each ink flow path inside the frame 200, and the temperatures of the ink ejected from the nozzle openings 34 may be uniformized by controlling the calorific values of the heating layers.

Figure 5:
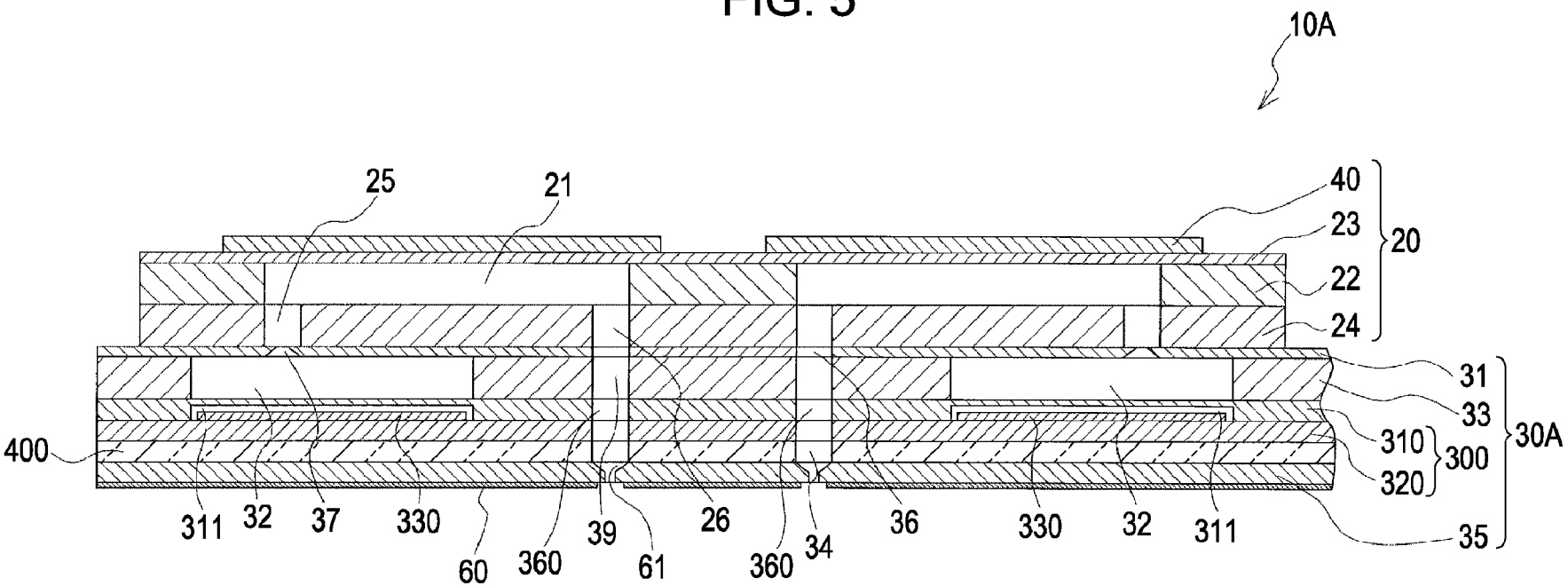
FIG. 5 is a schematic cross-sectional view of a head main body according to another embodiment of the invention.

In addition, in the ink jet recording head unit according to the above-described embodiments, an insulation layer may be disposed between the heating member and the nozzle plate 35. For example, as shown in FIG. 5, an insulation layer 400 may be disposed between the compliance substrate 300 and the nozzle plate 35.

Here, when the nozzle plate 35 is heated by the heating layer 330, ink is dried by the heat of the nozzle plate 35, and there may be a problem that the ink is solidified in the vicinity of the nozzle opening. However, by disposing the insulation layer 400 as described above, heating of the nozzle plate 35 by the heat from the heating layer 330 can be prevented, and thereby the problem dose not occur.

In addition, in the above-described embodiments, although the temperature sensor is disposed inside each ink chamber 110*a* to 110*b*, the position of the temperature sensor is not particularly limited as long as the temperature sensor can measure the temperature of the ink flowing inside each liquid flow path. For example, the temperature sensor may be disposed in the head main body 10 or the frame 200. However, it is preferable that the temperature sensor is disposed in a position close to the nozzle opening 34. By disposing the temperature sensor in a position close to the nozzle opening 34, the temperature of the ink that is close to the temperature of the ink ejected from the nozzle opening 34 can be detected. As a result, the temperatures of the ink ejected from the nozzle openings 34 can be uniformized more precisely.

In addition, for example, in the above-described embodiments, the ink jet recording head unit having a piezoelectric element of which layers are formed by green sheet attaching or green sheet printing, that is, so-called a thick-film-type piezoelectric element has been described as an example. However, the present invention is not limited thereto, and may be applied to an ink jet recording head unit having a piezoelectric element of which layers are formed by using a film forming method and a lithographic method, that is, so-called a thin-film-type piezoelectric element.

In addition, in the above-described embodiments, the ink jet record unit in which ink inside the ink cartridge 100 is supplied to the head main bodies 10 by using the converging flow paths 230*a* to 230*d* formed inside the frame 200 has been described as an example. However, the present invention is not limited thereto, and may be applied to an ink jet recording head in which the ink inside the ink cartridge 100 is supplied to the head main bodies 10 by using tubes.

In addition, in the above-described embodiments, the control unit 50 is disposed in addition to the driving circuit that drives the piezoelectric element. However, the function for controlling the heating layer may be implemented by the driving circuit.

In addition, in the above-described embodiments, the ink jet recording head unit as an example of a liquid ejecting head unit according to an embodiment of the present invention has been described. However, the basic configuration of the liquid ejecting head unit is not limited to that described above. The present invention is for a liquid ejecting head unit in a broad range, and may be applied to a liquid ejecting head unit that ejects liquid other than ink. As examples of liquid ejecting head units of other types, there are various types of recording head units used in an image recording apparatus such as a printer, a color material ejecting head unit used for manufacturing a color filter of a liquid crystal display or the like, and an electrode material ejecting head unit used for forming an electrode of an organic EL display, an FED (field emission display), or the like.

The present invention includes a configuration (for example, a configuration having the same function, method, and effects or a configuration having the same object and effects) that is substantially the same as that described in the embodiments. In addition, the present invention includes a configuration in which unessential parts of the configuration described in the embodiments is changed. In addition, the present invention includes a configuration that has the same operation and effects as those in the configuration described in the embodiments and a configuration that can achieve the same object as that in the configuration described in the embodiments. In addition, the present invention includes a configuration formed by adding known technology to the configuration described in the embodiments.

What is claimed is:

1. A liquid ejecting head unit comprising:

a plurality of pressure generating chambers;

a piezoelectric device located above the plurality of pressure generating chambers so as to be configured to apply pressure to liquid in at least one of the pressure generating chambers to cause the liquid to flow;

a plurality of reservoirs which are configured to communicate with the plurality of pressure generating chambers;

a plurality of spaces which face the plurality of reservoirs and are separated from the plurality of reservoirs by one or more layers, the one or more layers defining and enclosing the plurality of spaces;

a heating member provided entirely within each of the plurality of spaces an insulation layer formed between the one or more layers defining and enclosing the plurality of spaces and a nozzle plate comprising a plurality of nozzles, the insulation layer configured to prevent the heating members from heating the nozzle plate, a plurality of liquid flow paths connecting the plurality of nozzles with a liquid supply, the plurality of liquid flow paths including the plurality of pressure generating chambers and the plurality of reservoirs;

a control unit that controls each heating member; and temperature detecting units that detect temperatures of the liquid flowing through the liquid flow paths, wherein the control unit controls the plurality of heating members based on the temperatures of the liquid which are detected by the temperature detecting units and lengths of the liquid flow paths extending from the storage members to the head main bodies.

2. The liquid ejecting head unit according to claim 1, wherein the space is formed in a compliance substrate and the compliance substrate is made of metal.

3. A liquid ejecting apparatus comprising the liquid ejecting head unit according to claim 1.

4. The liquid ejecting head unit according to claim 1, wherein the heating member has a heating layer formed of Nichrome or copper.

* * * * *